US006110006A

United States Patent [19]

Chen

[11] Patent Number: 6,110,006

[45] Date of Patent: Aug. 29, 2000

[54] FUNCTIONAL BRA

[76] Inventor: Hui-Mei Chen, No. 49 Lane 199, San Jiun Street, Shu Lin Chen, Taipei Hsien, Taiwan

[21] Appl. No.: 09/353,541

[22] Filed: Jul. 14, 1999

[51] Int. Cl.[7] ..... A41C 3/14

[52] U.S. Cl. ..... 450/57; 450/38; 623/7; 623/8

[58] Field of Search ..... 450/38, 54–58; 623/7, 8

[56] References Cited

U.S. PATENT DOCUMENTS 4,298,998 11/1981 Naficy ..... 623/7

5,334,082 8/1994 Barker ..... 450/31

*Primary Examiner*—Gloria M. Hale

*Attorney, Agent, or Firm*—Pro-Techtor International Services

[57] ABSTRACT

A functional bra with a silicone gum cup padding in a design consistent with human body engineering. The silicone gum cup padding includes a silicone gum body, a polyurethane (PU) film, and a seaming cloth. The silicone gum body is thin in an upper part and thick toward the lower part. The silicone gum cup padding is made by covering the silicone gum body with said PU film, evacuating the inside of the PU film, sealing said PU film, and securing the seaming cloth on the sealed silicone gum body.

3 Claims, 6 Drawing Sheets

FUNCTIONAL BRA

BACKGROUND OF THE INVENTION

1. Field of the Invention

The invention relates to a functional bra, and in particular, to a functional bra having a silicone gum pad inserted inside the bra, which is characterized in that, by virtue of the silicone gum cup padding being designed based on body engineering, the feeling, softness, comfort, elasticity, specific gravity and rhythmic movement thereof conforms to the body.

2. Description of the Prior Art

Conventional bras such as that disclosed in R.O.C. Pat. No. 344950 have the following main features: a long adjusting gap is formed between the top end of the cup padding and the opposite breast peak to leave a transverse space for auto-adjusting. Gas permeating holes are formed at positions away from the adjusting gap to provide gas permeability while not allowing liquid to escape. The cup padding is a containing bag having liquid therein. Another prior art functional bra was disclosed in R.O.C. Pat. No. 319971, which has the following main features: a flexible padding with a liquid filler sealed therein was included.

These prior art bras have the disadvantages described below. Referring to FIG. 1 which shows a conventional functional bra in use, it can be seen that the functional bra 2 worn by the user 1 is formed by inserting a water bag 11 in the bra 10. The contents of the water bag 1 can be either water, oil, or other liquids. These liquids might be harmful to the human body. Since the process for preparing a water bag comprises filling an aqueous solution in a press-sealed plastic film, the edge of the press-sealed seam must be completely sealed. Fine holes that are difficult to detect are frequently produced, resulting in the slow leaking of the aqueous solution. Moreover, the water bag 11 is flat and has liquid filled therein, which can lead the bra 10 to sag downward due to the gravity, and thereby causes the back-hook closure to move upward.

SUMMARY OF THE INVENTION

One object of the invention is to provide a novel functional bra by combining a body-engineered silicone gum cup padding that is thin in an upper part but thick toward the lower part. The breast point of the user can conform comfortably to the silicone gum cup padding. By lifting and supporting the breast, the natural curvature of the breast is shown.

Another object of the invention is to provide a functional bra comprising a silicone gum cup padding that has superior safety, is soft and comfortable, and its elasticity, specific gravity and rhythmic movement sensation can give an especially comfortable feeling.

Still another object of the invention is to provide a functional bra comprising a silicone gum cup padding that contains an appropriate amount of polystyrene foam beads so as to reduce the weight of the bra.

DETAILED DESCRIPTION OF THE PREFERRED EMBODIMENT

Accordingly, the invention provides a functional bra with a silicone gum cup padding in a design consistent with human body engineering. The silicone gum cup padding comprises a silicone gum body, a polyurethane (PU) film and a seaming cloth. The padding is made by covering said silicone gum body with said PU film, evacuating the inside of said PU film, sealing said PU film, and finally, sticking said seaming cloth on the sealed silicone gum body.

Figure 1:
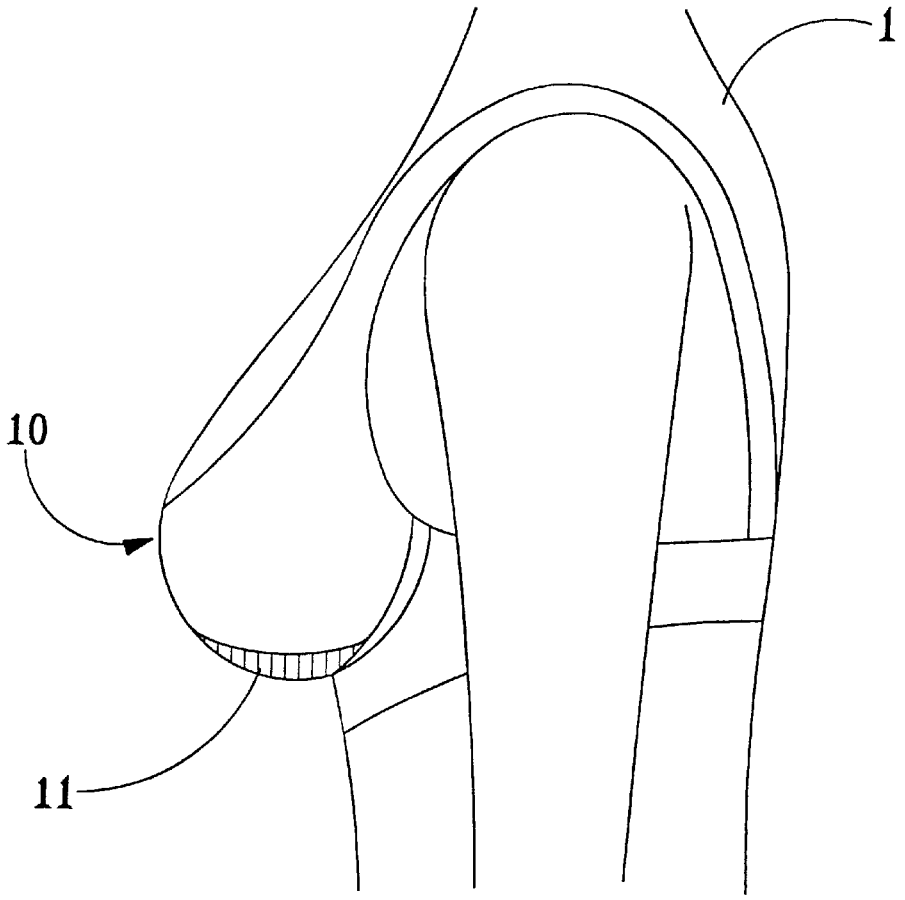
FIG. 1 shows a conventional functional bra in use.
Figure 2:
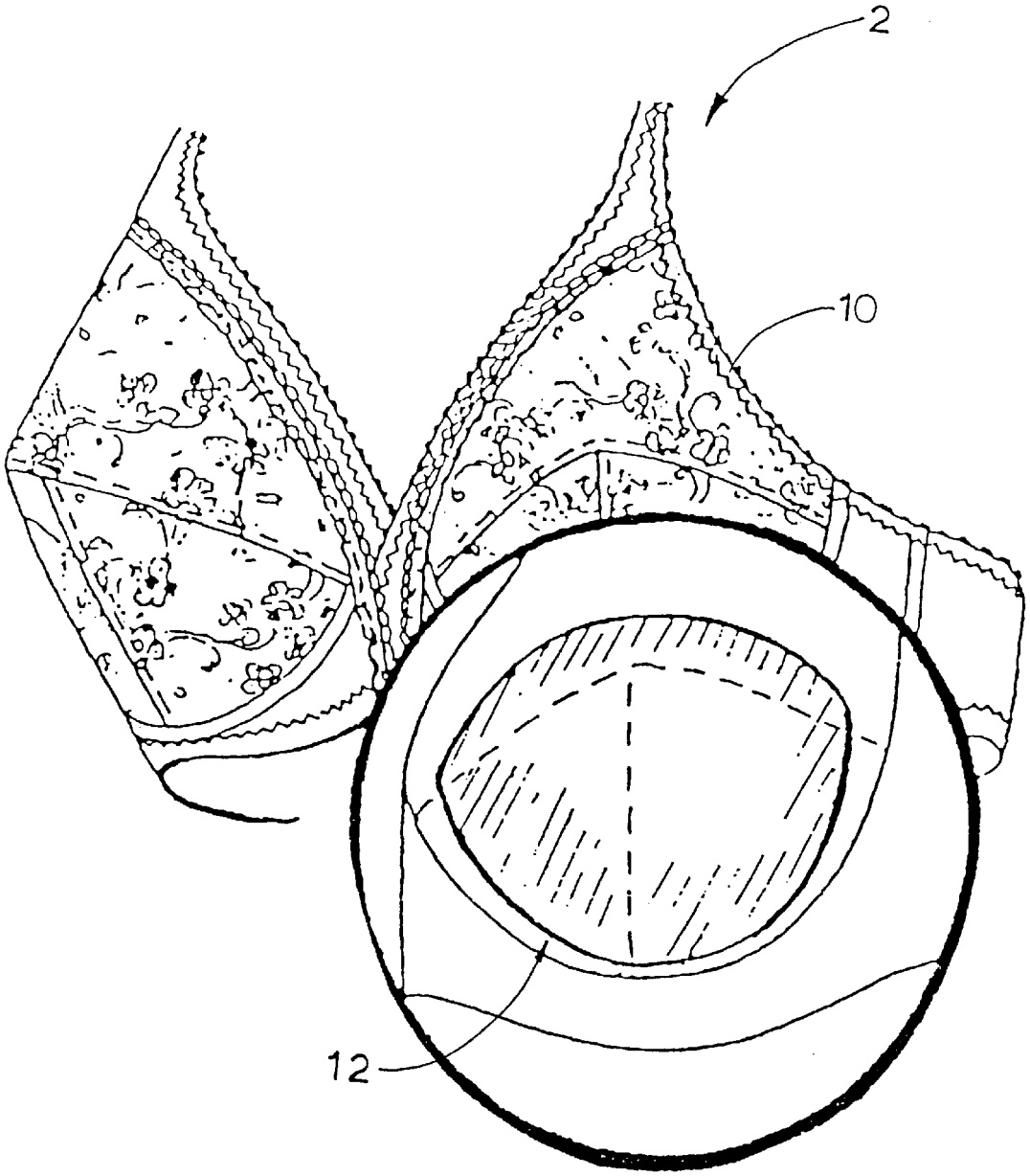
FIG. 2 shows a perspective view of the functional bra according to the invention.

Referring to FIG. 2, it can be seen that the functional bra 2 of the invention comprises a silicone gum cup padding 12 that is seamed between an outer layer and an inner layer of cloth at the cup padding area of the bra 10. The silicone gum cup padding 12 has a soft and comfortable texture. The silicone gum cup padding 12, if not affixed to the bra 10, can be used separately in conjunction with various types of bra 10 by placing the padding at the lower edge of a breast.

Figure 3:
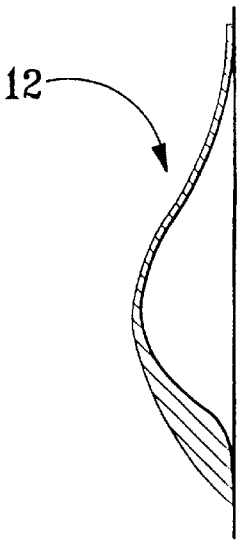
FIGS. 3A, 3B, and 3C show the silicone gum cup padding used in the functional bra according to the invention.
Figure 3:
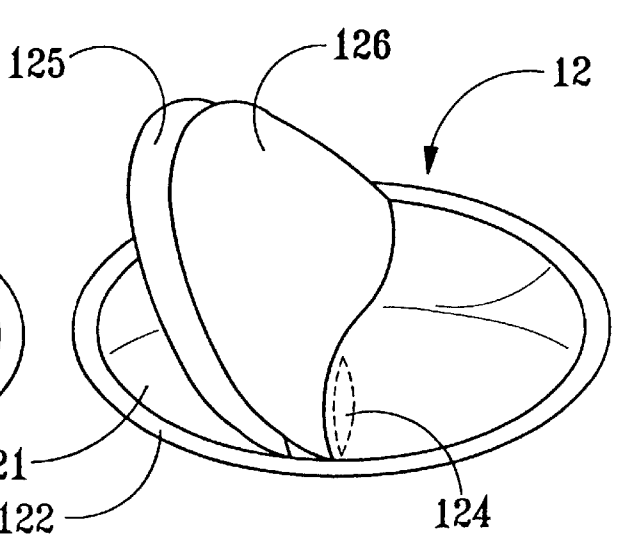
Figure 3A:
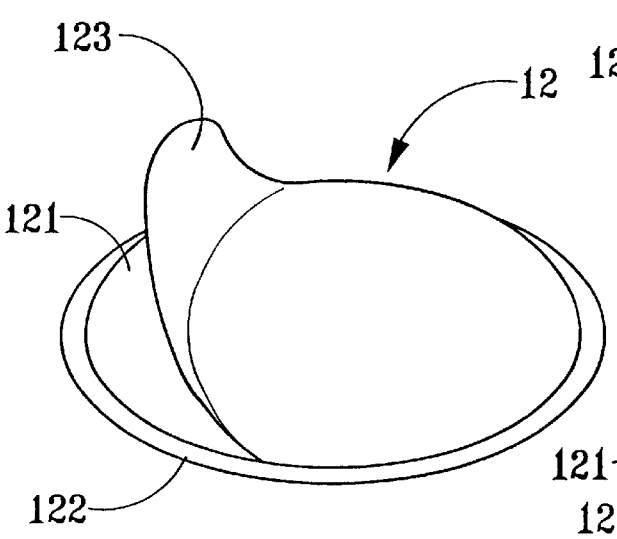

Referring now to FIGS. 3A–C, it can be seen from FIG. 3A that the interface between the silicone gum cup padding 12 and the bra comprises a silicone gum body 121, a PU film 122 and a seaming cloth 123. The PU film 122 is used to cover the silicone gum body 121. The air within the PU film 122 is evacuated. After sealing the outer seaming cloth 123 can be attached to the sealed silicone gum body 121 to facilitate a secure joining of the silicone gum cup padding 12 and the bra. FIGS. 3B and 3C show that the interface between the silicone gum cup padding 12 and the contact area on the breast skin contains further a non-woven cotton layer 125 and a cloth 126 in addition to the PU film 122. The silicone gum cup padding 12 is thin in an upper part but thick toward the lower part, and there is a groove 124 provided at a thicker area of the lower part. The groove 124 is used to allow bending of the silicone gum cup padding 12 more naturally, and conform better to a breast of the human body. The non-woven cotton layer 125 and cloth 126 secured therein have an effect of gas venting and sweat absorbing.

Figure 4C:
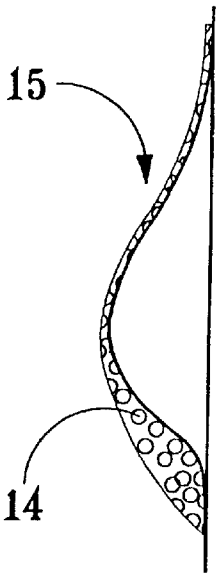
FIGS. 4A, 4B, and 4C show the silicone gum cup padding used in the functional bra according to the invention.
Figure 4B:
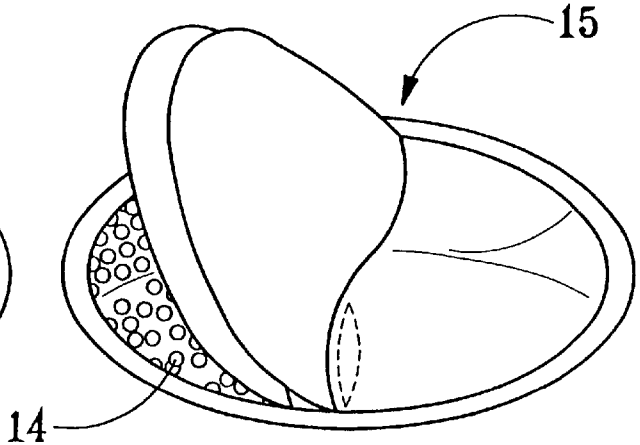
Figure 4A:
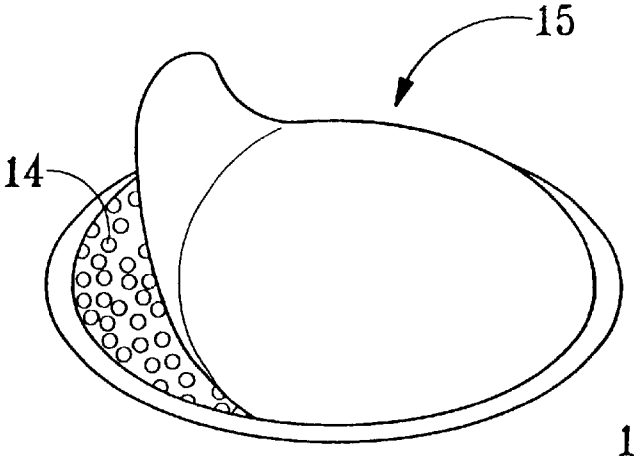

Referring to FIGS. 4A, 4B, and 4C, the silicone gum cup padding 15 shown therein is different from the silicone gum cup padding shown in FIG. 3 in that, since the silicone gum cup padding 15 is joined with the bra, in order to reduce the weight of the bra, polystyrene foam beads 14 are incorporated in the silicone gum body 151.

Figure 5:
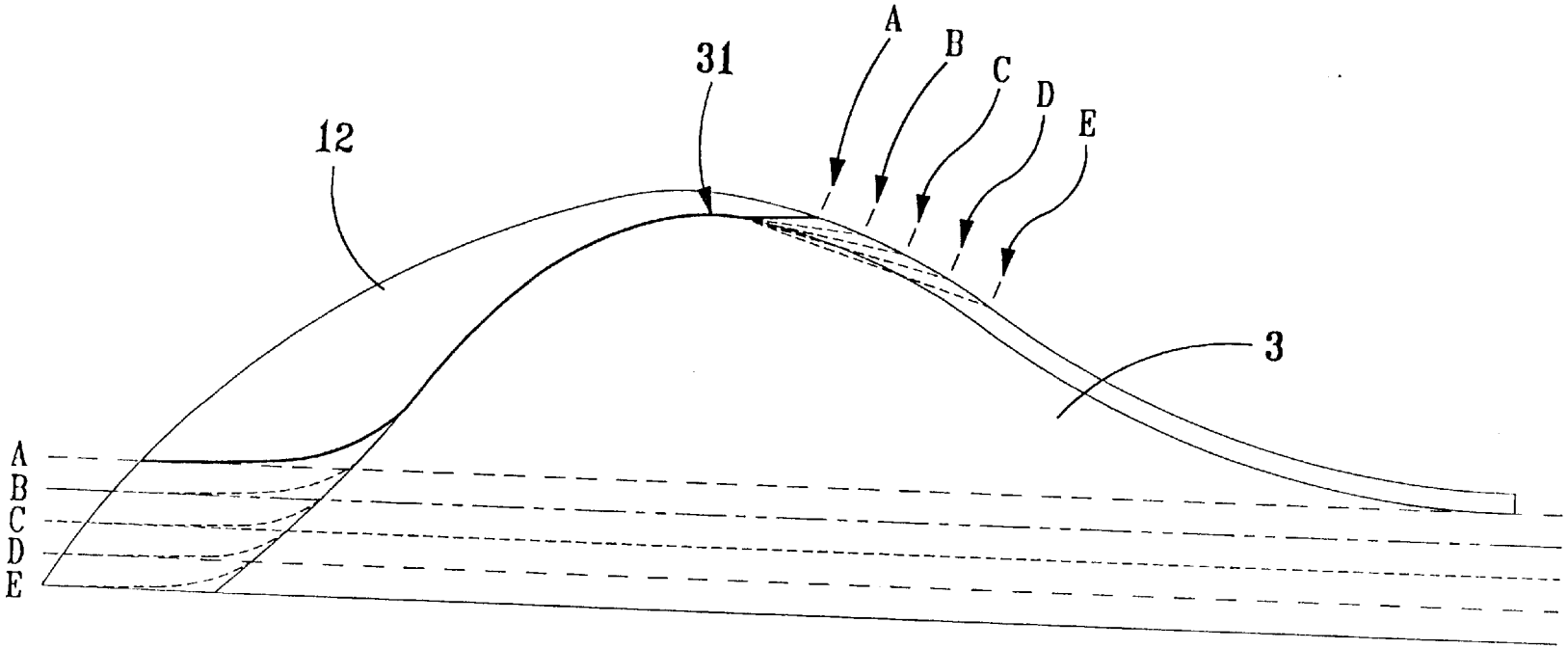
FIG. 5 is a cross-section view of the silicone gum cup padding.

Referring now to FIG. 5, the silicone gum cup padding 12 of the invention can have a variety of size that can be classified from small to large as A, B, C, D, E. etc. Thus, the user can select a proper size according to the size of the breast 3. When the size is larger, the length of the silicone gum cup padding 12 extends to both sides correspondingly. No matter how large the size is, the padding 12 will cover the breast point 31 on the breast 3.

Figure 6:
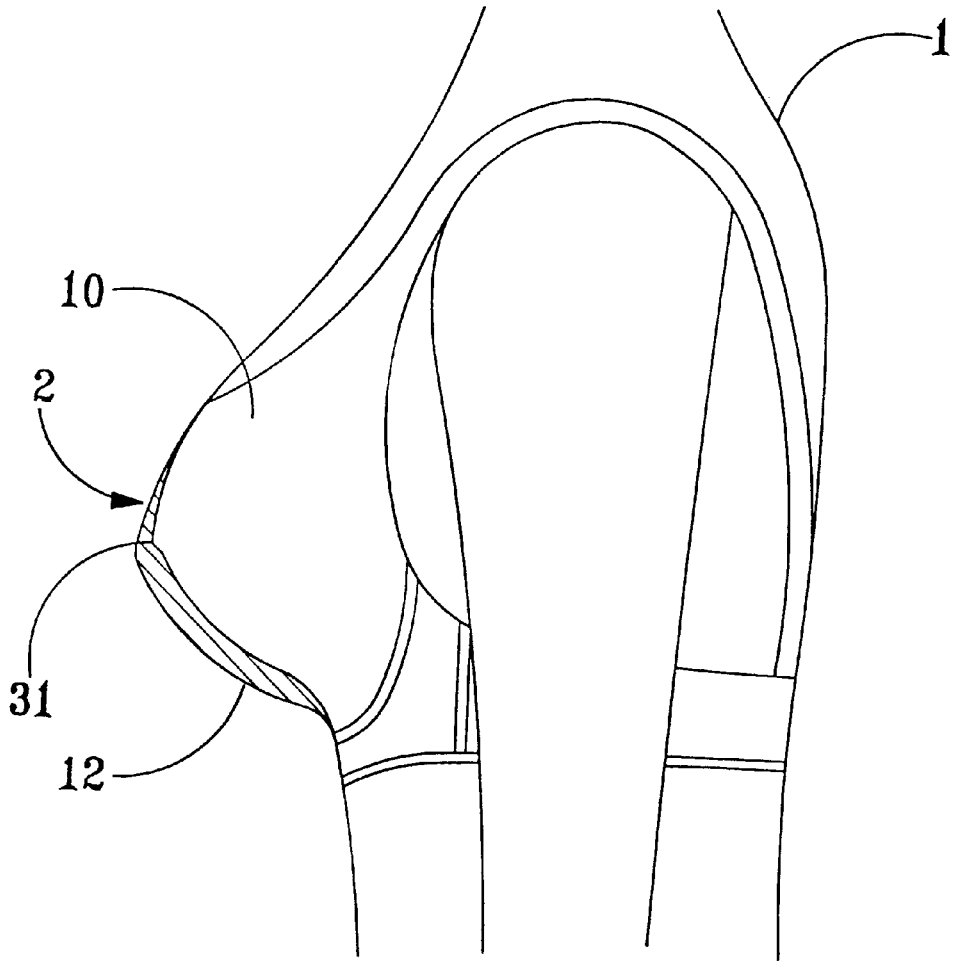
FIG. 6 shows the functional bra according to the invention in use.

Referring to FIG. 6, it is apparent that when the user 1 wears the functional bra 2, the silicone gum cup padding 12 in the bra 10 can lift the breast of the user 1 to achieve a plumping of the breast.

Features and Effectiveness

The functional bra provided by the invention, when compared with the above-mentioned patents and other conventional techniques, has the following advantages.

1. The silicone gum cup padding used in the functional bra according to the invention is designed based on the principle of human body engineering. The configuration of thin in the upper part but thick toward the lower part can lift the breast upward with a uniform supporting force. Moreover, it can massage the breast at all times.

2. The silicone gum cup padding according to the invention is safe and has a soft and comfortable texture.

3. The silicone gum cup padding according to the invention can have polystyrene beads incorporated therein to reduce the weight of the bra.

4. The silicone gum cup padding used in the functional bra according to the invention comprises further a layer of seaming cloth attached to the outer layer.

5. The silicone gum cup padding according to the invention, when not attached to the bra, can be used alone as a cup padding.

Many changes and modifications in the above-described embodiment of the invention can, of course, be carried out without departing from the scope thereof. Accordingly to promote progress in science and the useful arts, the invention is disclosed and is intended to be limited only by the scope of the appended claims.

What is claimed is:

1. A functional bra comprising:

two cups, each said cup is formed with a silicone gum cup padding attached to a bra cup, said silicone gum cup padding comprises a silicone gum body, a polyurethane film, and a seaming cloth; wherein said silicone gum body is covered by said polyurethane film, an interior of said polyurethane film is evacuated, edges of said polyurethane film are sealed, and said silicone gum body covered with polyurethane film is covered by said seaming cloth, said silicone gum body is thin at an upper part thereof and thick at a lower part thereof, and a groove is provided at a lower edge of the cup.

2. The functional bra as recited in claim 1 wherein:

said silicone gum body comprises polystyrene foam beads incorporated therein.

3. The functional bra as recited in claim 1 wherein:

a layer of non-woven cotton cloth is attached at a contact interface of said silicone gum cup padding and a user's breast skin, and a layer of cloth is then attached to said non-woven cotton cloth to facilitate gas venting and sweat absorbing.

* * * * *